US009090437B2

(12) United States Patent
Tarkiainen et al.

(10) Patent No.: US 9,090,437 B2
(45) Date of Patent: Jul. 28, 2015

(54) TROLLEY OF OVERHEAD CRANE

(75) Inventors: Johannes Tarkiainen, Hyvinkää (FI); Kimmo Rantala, Hyvinkää (FI); Ismo Kuivamäki, Hyvinkää (FI); Mats Åkesson, Hyvinkää (FI); Juhani Salovaara, Naantali (FI)

(73) Assignee: Konecranes Plc, Hyvinkaa (FI)

( * ) Notice: Subject to any disclaimer, the term of this patent is extended or adjusted under 35 U.S.C. 154(b) by 543 days.

(21) Appl. No.: 13/000,399

(22) PCT Filed: Jul. 3, 2009

(86) PCT No.: PCT/FI2009/050610

§ 371 (c)(1),
(2), (4) Date: Dec. 21, 2010

(87) PCT Pub. No.: WO2010/004088

PCT Pub. Date: Jan. 14, 2010

(65) Prior Publication Data

US 2011/0100753 A1 May 5, 2011

(30) Foreign Application Priority Data

Jul. 9, 2008 (FI) ..... 20085712

(51) Int. Cl.
*B66C 13/54* (2006.01)
*B66C 11/00* (2006.01)

(52) U.S. Cl.
CPC ..... *B66C 13/54* (2013.01); *B66C 11/00* (2013.01)

(58) Field of Classification Search
CPC ..... B66C 13/54
USPC ..... 182/36; 212/321, 322, 328–335, 343, 212/344, 346
See application file for complete search history.

(56) References Cited

U.S. PATENT DOCUMENTS

| | | | | | |
|---|---|---|---|---|---|
| 782,012 | A | * | 2/1905 | downs | 182/129 |
| 821,136 | A | * | 5/1906 | taylor | 212/316 |
| 968,813 | A | * | 8/1910 | taylor | 105/27 |
| 2,125,546 | A | * | 8/1938 | Corr | 5/86.1 |
| 3,393,768 | A | * | 7/1968 | Miller | 182/15 |
| 3,458,229 | A | * | 7/1969 | Cooper et al. | 294/81.2 |
| 3,874,513 | A | * | 4/1975 | Wilson | 212/290 |
| 4,217,971 | A | * | 8/1980 | Rivinius | 182/2.7 |
| 4,657,150 | A | * | 4/1987 | Glickman et al. | 212/344 |
| 4,730,743 | A | * | 3/1988 | Rosman | 212/312 |
| 5,582,467 | A | * | 12/1996 | Drolet et al. | 299/33 |
| 5,623,879 | A | * | 4/1997 | Gersemsky et al. | 105/150 |

(Continued)

FOREIGN PATENT DOCUMENTS

| | | | |
|---|---|---|---|
| CN | 200988737 | Y | 12/2007 |
| DE | 123365 | A1 | 12/1976 |

(Continued)

*Primary Examiner* — Katherine Mitchell
*Assistant Examiner* — Candace L Bradford
(74) *Attorney, Agent, or Firm* — Birch, Stewart, Kolasch & Birch, LLP

(57) ABSTRACT

The invention relates to a trolley (1) of an overhead crane, supported to be movable between two main girders (2), whereby there is a service platform (5) on the side of the trolley, the service platform being turnable or slidable in the upward direction and/or towards the trolley.

14 Claims, 2 Drawing Sheets

(56) References Cited

U.S. PATENT DOCUMENTS

| | | | | |
|---|---|---|---|---|
| 5,810,183 | A * | 9/1998 | Feider et al. | 212/291 |
| 5,893,471 | A * | 4/1999 | Zakula | 212/345 |
| 6,041,949 | A * | 3/2000 | Walker et al. | 212/179 |
| 6,631,818 | B1 * | 10/2003 | Ito | 212/330 |
| 7,210,589 | B2 * | 5/2007 | Iizuka | 212/273 |
| 7,216,741 | B2 * | 5/2007 | MacDonald et al. | 182/113 |
| 8,813,912 | B2 * | 8/2014 | Bennett et al. | 182/113 |
| 2005/0263976 | A1 * | 12/2005 | Brockway | 280/166 |
| 2007/0023379 | A1 * | 2/2007 | Kahlman et al. | 212/330 |
| 2010/0307868 | A1 * | 12/2010 | Bennett et al. | 182/36 |
| 2011/0100753 | A1 * | 5/2011 | Tarkiainen et al. | 182/129 |

FOREIGN PATENT DOCUMENTS

| | | | |
|---|---|---|---|
| DE | 2018708 | A | 10/1979 |
| JP | 52-079460 | A | 7/1977 |
| JP | 56-072681 | U | 6/1981 |
| JP | 11-011857 | A | 1/1999 |
| SU | 1168504 | A | 7/1985 |

* cited by examiner

TROLLEY OF OVERHEAD CRANE

BACKGROUND OF THE INVENTION

The invention relates to a trolley of an overhead crane, supported to be movable between two main girders, whereby there is a service platform on at least one side of the trolley.

A service platform is an important piece of equipment in cranes. If there is no service platform, it is difficult to service the crane, and extra arrangements need be made in order to access the object of service.

In a conventional solution, the service platform of the trolley is fixedly mounted on the trolley's frame structure, i.e. the trolley parts moving on a main girder, in such a manner that the service platform extends from these parts over the entire length of the trolley between the main girders and protrudes parallel to the main girders far outside the trolley's side contours to allow safe access to all objects of service on the service platform. Depending on the situation, the service platform is arranged either on both sides or only one side of the trolley.

A problem with this conventional solution is that approach dimensions of the trolley, such as the measurement between the trolley's lifting hook and a crane hall wall or the measurement between lifting hooks, increase considerably when there are several trolleys on the same hoist bridge. This may restrict the operating region of the crane considerably. To avoid collision damages of the trolley, various buffer arrangements or extensions to the buffers at the ends of the trolley must also be provided.

SUMMARY OF THE INVENTION

It is an object of the invention to eliminate the above drawbacks. This object is achieved by a trolley structure of an overhead crane according to the invention, characterized in that the service platform is turnable or slidable in the upward direction and/or towards the trolley.

The service platform is preferably suspended at its opposite ends from the trolley's end supports resting on the main girders, for instance, and arranged to be turnable about a horizontal axis that is perpendicular to the main girders, and the service platform comprises a floor surface and a side wall/railing construction, whereby in an upper position the floor surface is substantially in an upright position on the side of the trolley inside its side contours and the side wall/railing construction is on top of the trolley.

With a movable service platform, it is possible to reduce the approach dimensions of a trolley, which often are a deciding argument when selecting a crane. While the dimension of the crane thus increases, it requires less space at the site of use.

In the solution of the invention, the trolley need not be provided with buffer extensions or other additional buffer constructions either, because the service platform that is lifted to the upper position after the service does not increase the measurements of the trolley in its direction of motion. The compactness of the service platform turned upwards also provides the trolley with a well-defined appearance, and it also acts as a protection against dust and rain for the trolley and its lifting components.

If the rest of the trolley structure and the positioning thereof are planned out to allow that all components in need of service can be serviced from one side of the trolley, there is no need to have any service platform on the other side of the trolley.

These and other preferred embodiments of the invention are disclosed in the claims.

LIST OF FIGURES

The invention will now be described in greater detail by means of a preferred embodiment and with reference to the attached drawings, in which FIG. 1 shows a trolley of an overhead crane according to the invention obliquely from above, with its service platform in a lower position;

DETAILED DESCRIPTION OF THE INVENTION

Figure 1:
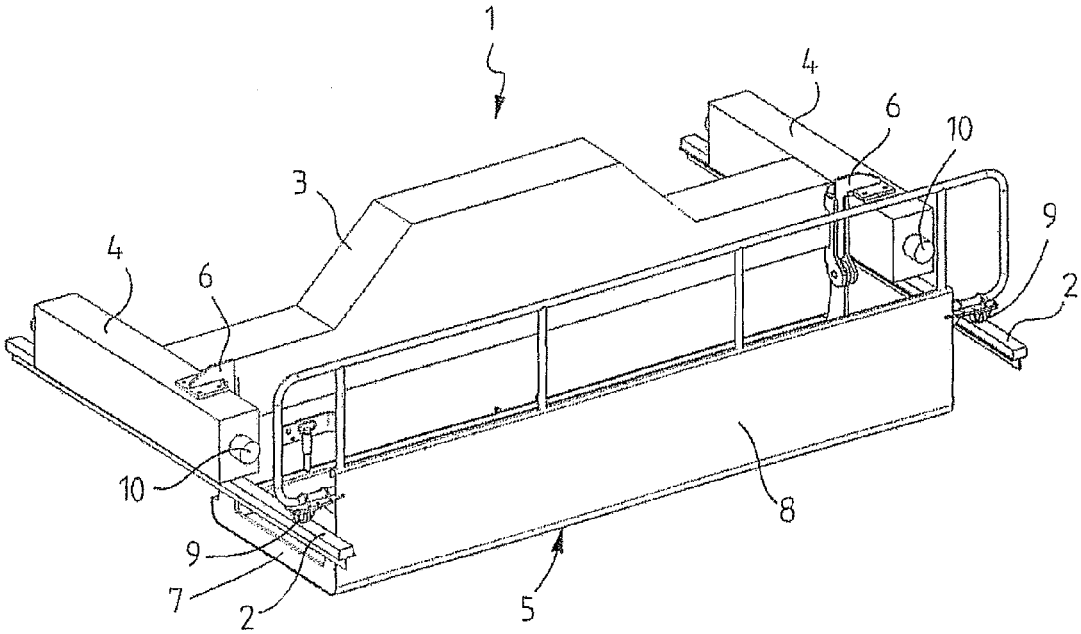
Figure 2:
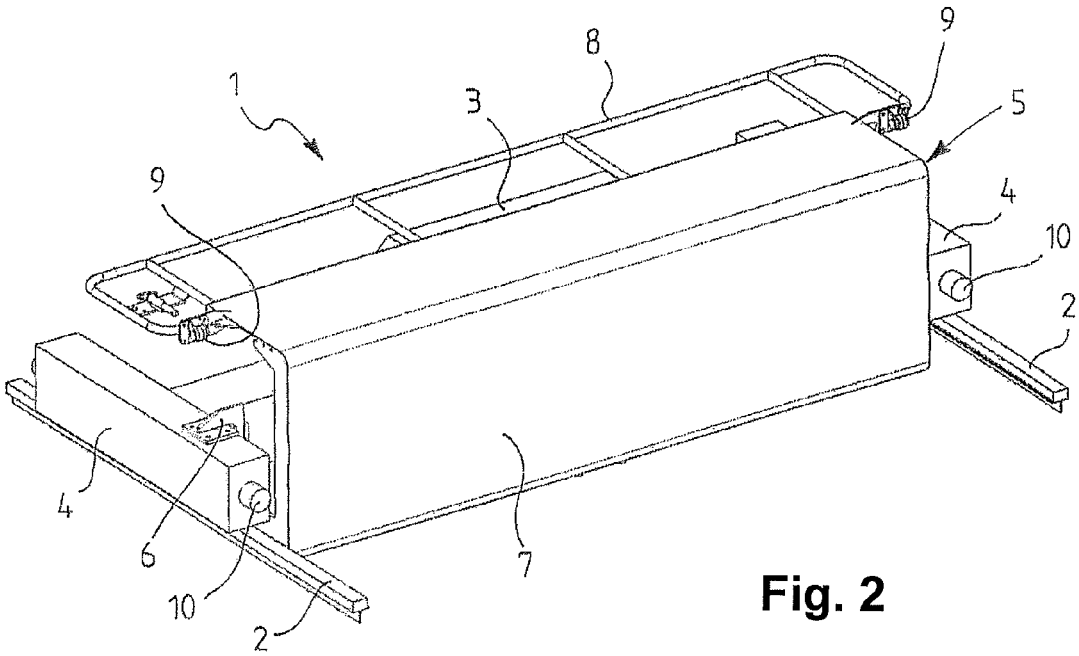
FIG. 2 shows a trolley of an overhead crane according to the invention obliquely from above, with its service platform in an upper position.
Figure 3:
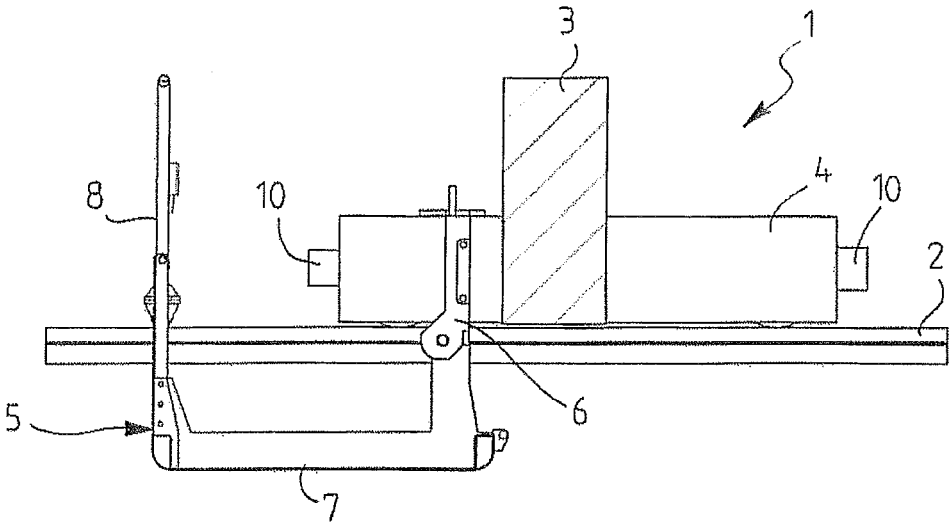
FIG. 3 shows a trolley of an overhead crane according to the invention from the side, with its service platform in a lower position.
Figure 4:
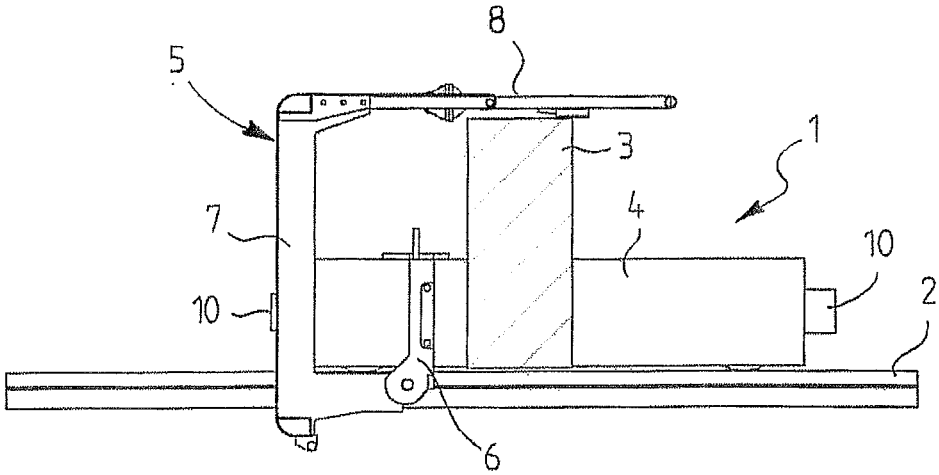
FIG. 4 shows a trolley of an overhead crane according to the invention from the side, with its service platform in an upper position.

With reference to the drawings there is shown a trolley 1 of an overhead crane according to the invention, the trolley being supported to be movable between two main girders in a usual way, the drawings only showing rails 2 of the main girders.

The trolley 1 comprises a load beam 3 extending between the rails 2 of the main girders and comprising pulleys for the crane cables. This equipment as well as lifting machinery, transfer equipment, cable drums or lifting hooks are not shown in these principle views, since they have no essential relevance to the invention. The ends of the load beam 3 are provided with end supports 4 of the trolley 1, which are fitted with at least wheels, on which the trolley 1 moves along the rails 2 of the main girders. At the ends of the end supports 4 there are buffers 10 to damp potential collisions.

It is essential to the invention that on the side thereof is a service platform 5, which can be turned or slid upwards and/or towards the trolley 1. The turning occurs around a specific rotation axis and the sliding occurs along suitable slide bars, for instance, which may be curved slide bars, when the service platform 5 is slid upwards and towards the trolley 1, and substantially horizontal slide bars, when the service platform 5 is slid directly towards the trolley 1.

This embodiment presents a turnable service platform 5, the service platform 5 being suspended at its opposite ends from the trolley's end beams 4 resting on the main girders 2 and arranged to be turned about a horizontal axis that is perpendicular to the main girders 2. The suspension of the service platform 5 is performed by suspension means 6, which rest on the respective end support 4 and at the lower ends of which there are, under the end support 4, suspension and pivot points for mounting the service platform 5.

The service platform 5 comprises a floor surface 7 and a side wall/railing construction 8, whereby in an upper position the floor surface 7 is substantially in an upright position on the side of the trolley 1 inside its side contours and the side wall/railing construction 8 is on top of the trolley 1.

In the lower service position the service platform 5 is supported on the rails 2 of the main girders by means of rolls 9 at the ends of the side wall/railing construction 8, the rolls also allowing the trolley 1 to be driven in the lower position of the service platform, if this is required during service, for instance. Such a support is also safe and enables a lighter structure than, for instance, in a solution where the service platform 5 would be supported in the service position by means of stoppers provided at the suspension means 6, for example.

To move the service platform 5 or to facilitate its movement between the upper and the lower position, there may be provided auxiliary means including, for instance, a lifting motor, winch, springs and balance weight. These are not shown separately in the drawings, since they may be positioned and used in a wide variety of ways. However, for safety reasons it is important that the service platform 5 can be locked in its upper position. The locking may be carried out in various ways, for instance by providing it on top of a centre section 3 of the trolley.

If the rest of the trolley's structure and the positioning thereof are also planned so as to allow that all components in need of service can be serviced from one side of the trolley 1, it is sufficient to have a service platform 5 only on one side of the trolley 1, as shown in the drawings.

The above description and the related drawings are only intended to illustrate the present invention. A person skilled in the art may thus vary the details of the invention without departing from the scope or spirit of the invention disclosed in the accompanying claims. Thus, the suspension of the service platform, for instance, may be implemented in many ways and in locations other than the end supports of the trolley. The same applies to supporting the service platform in its lower position. Measurements of the service platform may naturally vary to a great extent. Turning the service platform around the fixed rotation axis is not the only alternative to take it up in the manner described above, but it may also be carried out by slide bars known from lever gear doors of garages, for example, if they are fitted for the structure of the trolley, particularly its end supports.

The invention claimed is:

1. A trolley of an overhead crane, movably supported on rails of two main girders, whereby there is a service platform on at least one side of the trolley, wherein the service platform is turnable or slidable in an upward direction towards the trolley into an upper position, and in a lower position, the service platform is supported on the rails of the main girders, wherein at ends of a side wall or railing construction of the service platform there are rolls, with the service platform in a lower position, the rolls rest on the rails of the main girders, and wherein the service platform is at least partially located below a bottom of the rails of the main girders when the service platform is in the lower position.

2. The trolley as claimed in claim 1, wherein the service platform is suspended at opposite ends of the service platform from end supports of the trolley resting on the main girders, and arranged to be turnable about a horizontal axis that is perpendicular to the main girders.

3. The trolley as claimed in claim 2, wherein the service platform comprises a floor surface and the side wall or railing construction, wherein when the service platform is in the upper position of the service platform, the floor surface is substantially in an upright position on the side of the trolley, the side wall or railing construction is on top of the trolley and above the floor surface, and a top of each of the rolls is located above the entire floor surface, and when the service platform is in the lower position, the floor surface is entirely located below the bottom of the rails of the main girders, the side wall or railing construction is substantially in an upright position, and a bottom portion of the side wall or railing construction is located below the bottom of the rails of the main girders.

4. The trolley as claimed in claim 2, wherein, to move the service platform or to facilitate movement of the service platform between an upper and the lower position, there are provided auxiliary means including a lifting motor, winch, springs and balance weight.

5. The trolley as claimed in claim 2, wherein the service platform is locked when the service platform is in the upper position.

6. The trolley as claimed in claim 2, wherein the service platform is only located on one side of the trolley.

7. The trolley as claimed in claim 1, wherein the service platform comprises a floor surface and the side wall or railing construction, wherein when the service platform is in the upper position of the service platform, the floor surface is substantially in an upright position on the side of the trolley, the side wall or railing construction is on top of the trolley and above the floor surface, and a top of each of the rolls is located above the entire floor surface, and when the service platform is in the lower position, the floor surface is entirely located below the bottom of the rails of the main girders, the side wall or railing construction is substantially in an upright position, and a bottom portion of the side wall or railing construction is located below the bottom of the rails of the main girders.

8. The trolley as claimed in claim 7, wherein, to move the service platform or to facilitate movement of the service platform between the upper and the lower position, there are provided auxiliary means including a lifting motor, winch, springs and balance weight.

9. The trolley as claimed in claim 7, wherein the service platform is locked when the service platform is in the upper position.

10. The trolley as claimed in claim 7, wherein the service platform is only located on one side of the trolley.

11. The trolley as claimed in claim 1, wherein, to move the service platform or to facilitate movement of the service platform between the upper position and the lower position, there are provided auxiliary means including a lifting motor, winch, springs and balance weight.

12. The trolley as claimed in claim 11, wherein the service platform is locked when the service platform is in the upper position.

13. The trolley as claimed in claim 1, wherein the service platform is locked when the service platform is in the upper position.

14. The trolley as claimed in claim 1, wherein the service platform is only located on one side of the trolley.

* * * * *